United States Patent [19]

Eifort

[11] 4,178,053

[45] Dec. 11, 1979

[54] ZERO-INSERTION FORCE ELECTRICAL CONNECTOR

[75] Inventor: Ralph C. Eifort, Wichita, Kans.

[73] Assignee: NCR Corporation, Dayton, Ohio

[21] Appl. No.: 877,432

[22] Filed: Feb. 13, 1978

[51] Int. Cl.[2] ..... H01R 13/54

[52] U.S. Cl. ..... 339/75 MP

[58] Field of Search ..... 339/75 MP, 75 M, 75, 339/74 R

[56] References Cited

U.S. PATENT DOCUMENTS

| | | | |
|---|---|---|---|
| 3,475,717 | 10/1969 | Lane | 339/75 MP |
| 3,541,490 | 11/1970 | Berg | 339/75 M |
| 3,568,134 | 3/1971 | Anhalt | 339/75 MP |
| 3,793,609 | 2/1974 | McIver | 339/74 R |
| 3,818,419 | 6/1974 | Crane | 339/74 R |
| 3,963,317 | 6/1976 | Eigenbrode | 339/74 R |
| 4,077,688 | 3/1978 | Cobaugh | 339/74 R |
| 4,080,027 | 3/1978 | Benasutti | 339/75 MP X |

*Primary Examiner*—Joseph H. McGlynn

*Assistant Examiner*—John S. Brown

*Attorney, Agent, or Firm*—J. T. Cavender; Albert L. Sessler, Jr.; Elmer Wargo

[57] ABSTRACT

A connector comprising a female member having a slot therein to receive a complementary member such as a male connector or a printed circuit board. First and second groups of contacts are located in the female member to engage the complementary member. An actuating structure including an actuating member is used for sequentially moving the contacts of the first and second groups between a first or "restored" position and a second or "expanded" position when the actuating member is moved in a first direction, whereby the contacts of the first group are first moved to the expanded position, and thereafter, the contacts of the second group are moved to the expanded position upon further movement of said actuating member in said first direction. When the contacts of the first and second groups are moved to the expanded positions, the complementary member may then be inserted into the female member with zero-insertion force.

7 Claims, 18 Drawing Figures

26
198
178
194
188

178
182

180
26
178
180
184
188
191

178
182
180
184
186
198

178
180
26
182

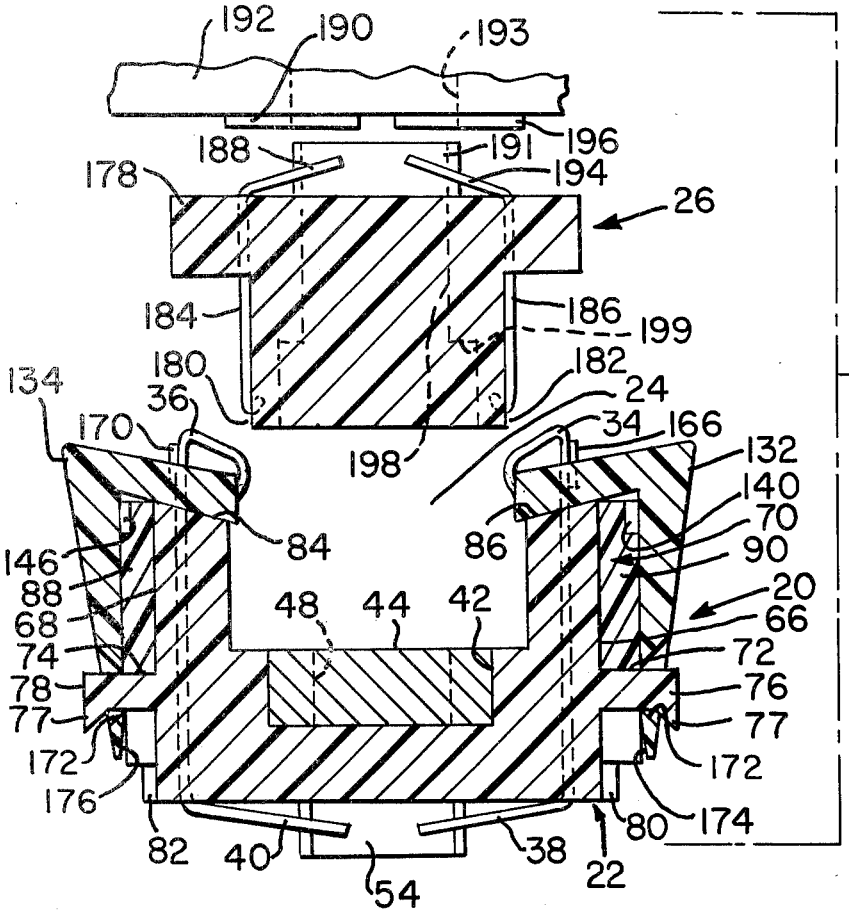
FIG. 16
FIG. 17
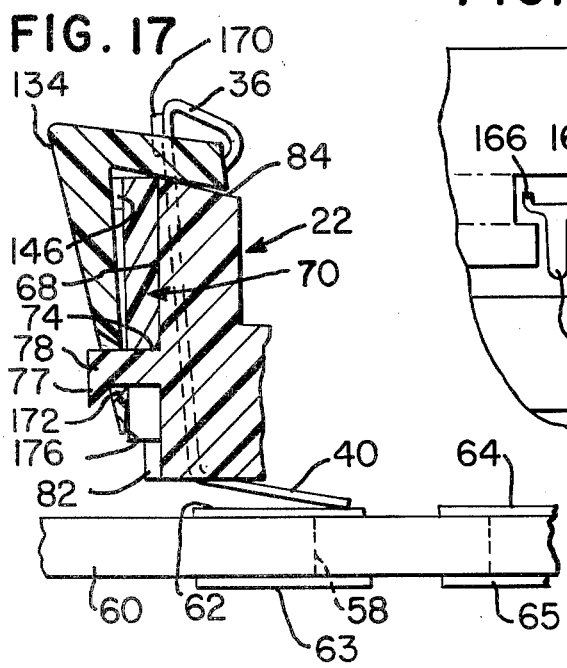
FIG. 18
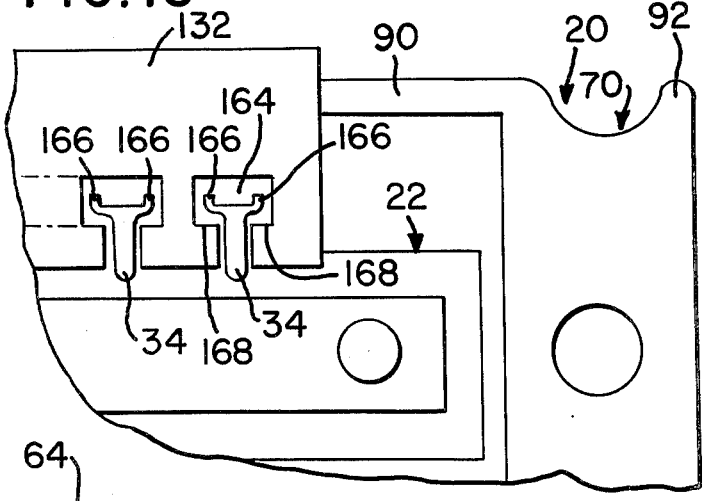

ZERO-INSERTION FORCE ELECTRICAL CONNECTOR

BACKGROUND OF THE INVENTION

This invention relates to an electrical connector of the zero-insertion force type.

In recent years, there has been an increase in the number of contacts present in electrical connectors of the type associated with printed circuit boards, for example, and an increase in the pressure with which the contacts engage the associated contacts on the printed circuit board or other mating connector. The increased number of contacts and the increased contact pressure make it extremely difficult to insert the male or mating connector into the receiving connector; this has led to the development of zero-insertion force, electrical connectors. A zero-insertion force connector is one in which terminals which are included in the connector are moved out of the path of insertion of a complementary member such as a printed circuit board or male member and are subsequently released or moved to engage the associated contacts on the complementary member. In this way, the complementary member may be freely placed in position for engagement by the terminals in the connector without any wear on the contacts of the complementary member.

Some prior art zero-insertion force connectors are shown in the following U.S. Pat. Nos. 3,793,609, 3,818,419 and 3,963,317.

A known connector, not shown in the above patents, includes a body having a slot therein to receive a mating connector, with fifty pairs of opposed contacts being located in the slot. An actuating member, slidably mounted in the connector, is used to simultaneously expand all fifty pairs of contacts to an extended or expanded position by a single pulling action on the actuating member to thereby enable the mating connector to be inserted between the contacts with zero-insertion force.

SUMMARY OF THE INVENTION

This invention relates to a zero-insertion force, electrical connector of the type including a member having an aperture or slot therein to receive a complementary member. In a specific embodiment of this invention, first and second groups of contacts located in the member are used to engage a complementary member such as a male connector member or a printed circuit board. Actuating means including an actuating member are used for sequentially moving the contacts of the first and second groups between a "restored" or a first position and an "expanded" or a second position whereby, the actuating member, when moved in a first direction, is effective to move the contacts of the first group to the second position, and whereby further movement of the actuating member in the first direction is effective to move the contacts of the second group to the second position to enable the complementary member to be inserted in the slot with zero-insertion force.

A feature of this invention is that the contacts of the first and second groups are sequentially moved to the expanded position in one "pulling action" of the actuating member to enable the contacts to be more easily expanded when compared to prior art structures. Another feature is that the contacts of the first and second groups are simultaneously moved back to the restored position in one "pushing action" to engage the contacts on the complementary member inserted into the slot of the member.

Another feature of this invention is that the actuating means including the actuating member have been redesigned to avoid twisting of the actuating member during the "pulling action" when compared to the known connector described earlier herein.

These advantages and others will be more readily understood in connection with the following specification, claims and drawing.

BRIEF DESCRIPTION OF THE DRAWING

FIG. 16 is a greatly-enlarged, exploded view, in cross section, of the connector of this invention showing the female member, with the male member being positioned above the slot in the female member for insertion therein and with the view being taken along the line 16—16 of FIG. 11;

FIG. 17 shows a portion of the connector shown in FIG. 16 and is used to illustrate how the actuating means moves the contacts in the female member to the expanded position shown to enable the male member to be inserted in the slot with zero-insertion force; and FIG. 18 shows that portion of the assembled connector which is included in the dashed enclosure A shown in FIG. 11, and also shows more detail of the contacts located therein.

DETAILED DESCRIPTION OF THE INVENTION

A preferred embodiment of the connector 20 of this invention includes the female member designated generally as 22 (FIGS. 1–5) having a slot 24 therein to receive a complementary member such as the male member designated generally as 26 and shown in FIGS. 6–9.

Figures 1, 2, 3, 4, 5:
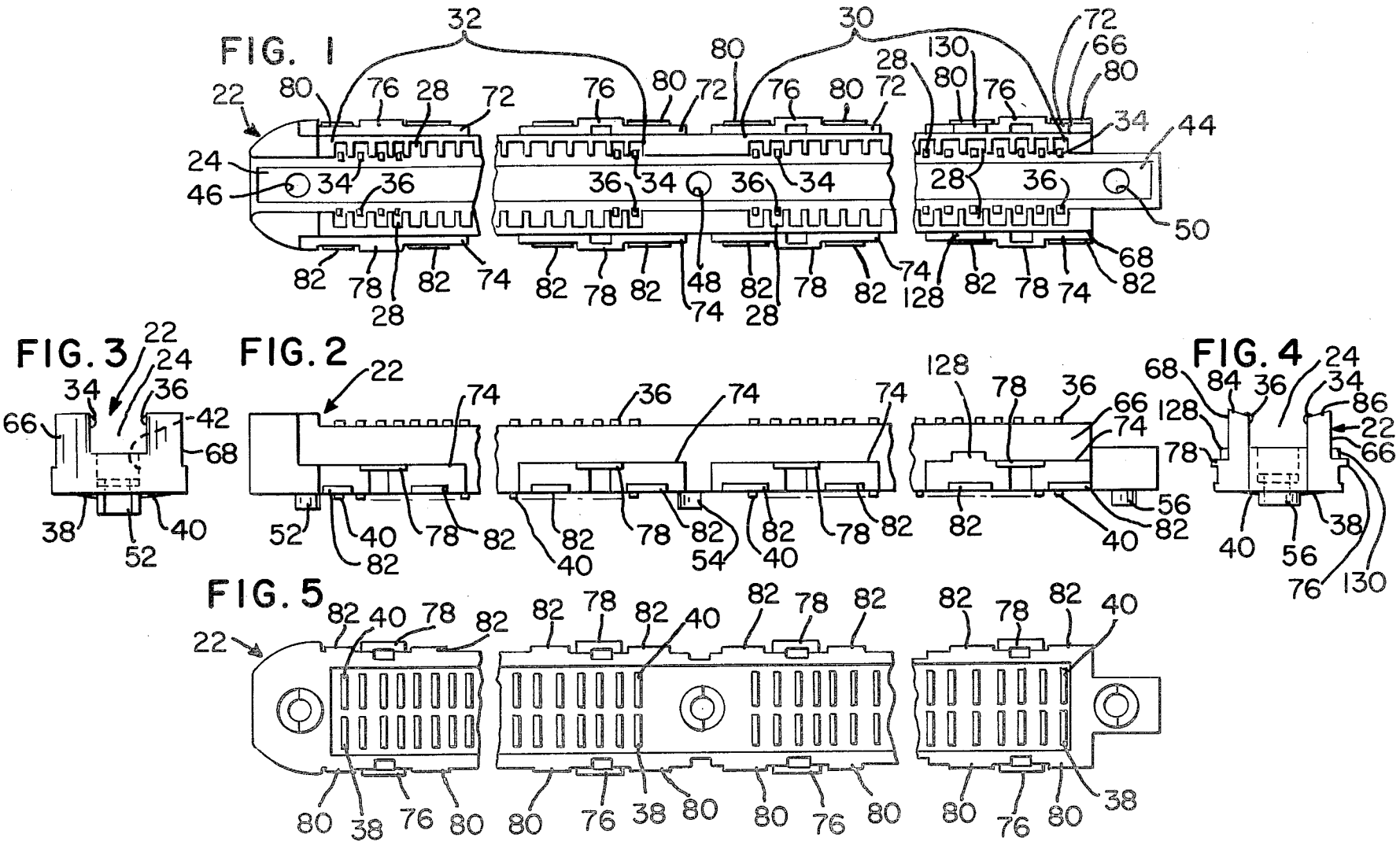
FIG. 1 is a plan view of a female member of the connector selected to portray a specific embodiment of this invention, with the female member being shown slightly enlarged and with certain repetitious parts thereof being eliminated to simplify the drawing.
FIG. 2 is a side view of the female member shown in FIG. 1, showing certain abutment members on the sides thereof.
FIG. 3 is a left, end view of the female member showing the pairs of contacts therein which are moved to an expanded position to enable a cooperating member such as that shown in FIG. 16 to be inserted in the slot in the female member with zero-insertion force.
FIG. 4 is a right, end view of the female member.
FIG. 5 is a bottom view of the female connector.
Figures 6, 7, 8, 9, 10:
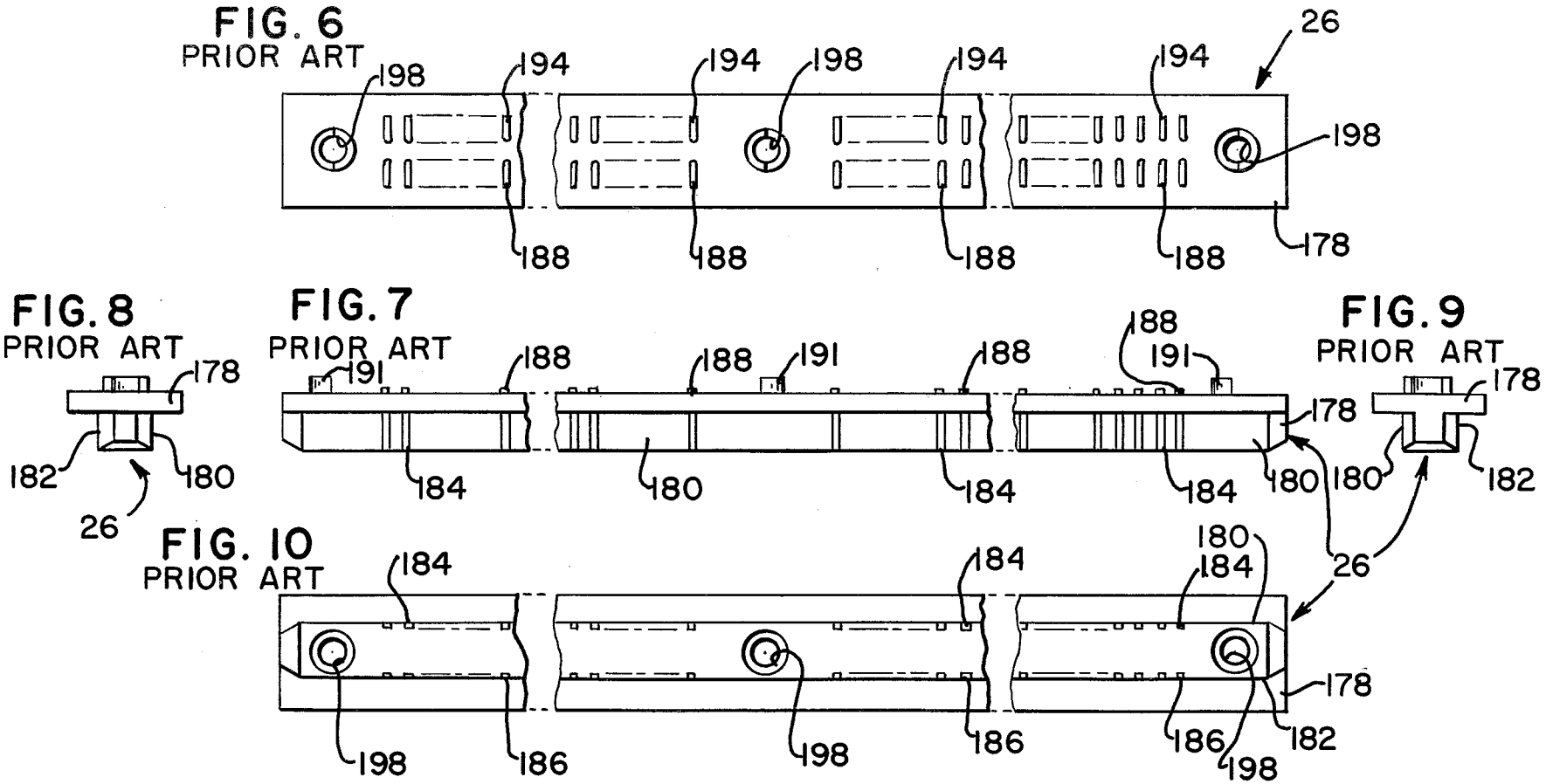
FIG. 6 PRIOR ART
FIG. 9 PRIOR ART
FIG. 7 PRIOR ART
FIG. 10 PRIOR ART
FIG. 8 PRIOR ART
FIG. 6 is a top view of a prior art complementary member or male member which is inserted in the slot of the female member.
FIG. 7 is a side view of the male member, showing the contacts thereof which are engaged by the contacts in the female member.
FIG. 8 is a left, end view of the male member shown in FIG. 7.
FIG. 9 is a right, end view of the male member.
FIG. 10 is a bottom view of the male member.

The female member 22 is made of an insulating, conventional, tough, plastic material such as glass-filled nylon and includes a plurality of cells 28 which are arranged in opposed relationship as shown in FIG. 1. First and second groups 30 and 32 of contacts are located within the cells 28, with each contact 34 and 36 forming an opposed pair of contacts within each of the groups 30 and 32. Each of the contacts 34, 36 is made of a conventional tough, conductor material such as a beryllium-copper alloy and is conventionally press fitted into an appropriate slot (not shown) in the respective cell 28, and thereafter, the bottom end 38 of each contact 34 is bent over towards the slot 24, as is best shown in FIG. 16, and the bottom end 40 of each contact 36 is similarly bent over. The contacts 34 and 36 are biased towards the center of the slot 24 when in the restored or relaxed state shown in FIG. 16.

The female member 22 has a recess 42 into which the metal reinforcing bar 44 is inserted as is best shown in FIG. 16. The bar 44 has threaded holes 46, 48, and 50 therein which are aligned with semi-circular, tubular extensions 52, 54, and 56, respectively, which depend from the female member 22; these extensions facilitate locating the female member 22 with respect to matching locating holes (such as hole 58 in FIG. 17) which are present in a cooperating member such as the printed circuit board 60. When the female member 22 is secured to the board 60 by fasteners, such as a fastener (not shown) passing through the hole 58 in board 60 to the threaded hole 48 in the bar 44, the contacts 40 engage the associated contacts 62 on the board 60, and the contacts 38 engage the contacts 64 (FIG. 17) to provide an electrical connection therebetween. In a typical installation, the circuit board 60 would have contacts 63 and 65 located opposite the contacts 62 and 64, and a male member such as 26 would be positioned on the side of circuit board 60 containing the contacts 63 and 65. A fastener (not shown) would then be inserted in the hole 198 (FIG. 6) in the male member, and would pass through the hole 58 into the threaded hole 48 of the female member 22 to secure the female member 22 and a male member 26 to opposed sides of the circuit board 60. Similarly, a female member 22 would be secured to the side of the circuit board 192 which is opposite to the side containing the contacts 190 and 196 shown in FIG. 16.

The female member 22 has opposed sides 66 and 68 against which an actuating member 70 (FIGS. 11, 16 and 17) moves to move the contacts of the first and second groups 30 and 32 between the relaxed or restored position shown in FIG. 16 and the expanded position shown in FIG. 17 to enable the complementary member 26 to be inserted in the slot 24 with zero-insertion force as previously explained. The side 66 has a plurality of shoulders 72 formed thereon, and similarly, the side 68 has a plurality of shoulders 74 formed thereon, as shown in FIGS. 1 and 2. The shoulders 72 have projections 76 extending therefrom for purposes to be later described herein, and similarly, the shoulders 74 have projections 78 extending therefrom. The projections 76 and 78 each also have a flange 77 (FIGS. 16 and 17) depending from the outer extremity thereof as shown for flange 76 in FIG. 16. The member 22 also has a plurality of projections 80 (FIGS. 1 and 16) extending from the side 66 of the member 22, and similarly, the side 68 thereof has a plurality of projections 82 extending therefrom. The projections 80 and 82 result from separating certain parts such as the retractor wings 132, 134, 136 and 138 (FIG. 11) from the female member 22 after being molded therewith to effect economies of production. The member 22 has sloping top sides 84 and 86 as is best shown in FIGS. 4 and 16. That which has been described so far in the detailed description of this invention with regard to the female member 22 relates to the known connector mentioned earlier herein.

Figure 11:
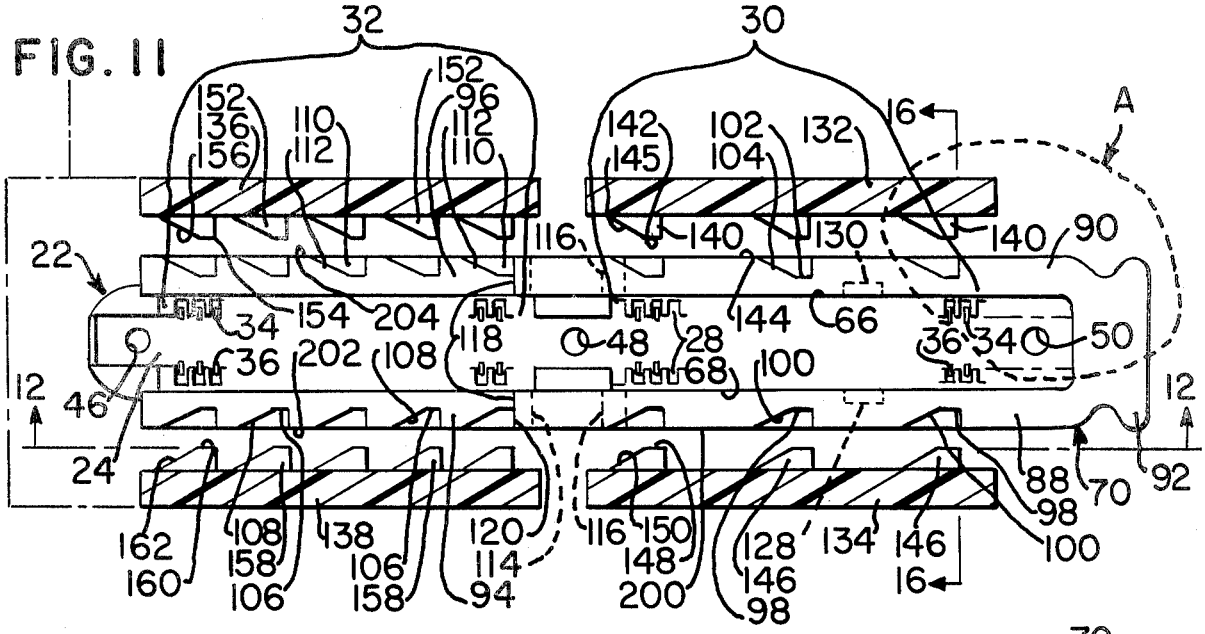
FIG. 11 is an exploded, plan view of the connector of this invention, with the female member thereof being shown in full size and with certain portions of the actuating means for moving the contacts between restored and expanded positions being shown in exaggerated size and with certain portions thereof being removed to facilitate the showing.
Figure 12:
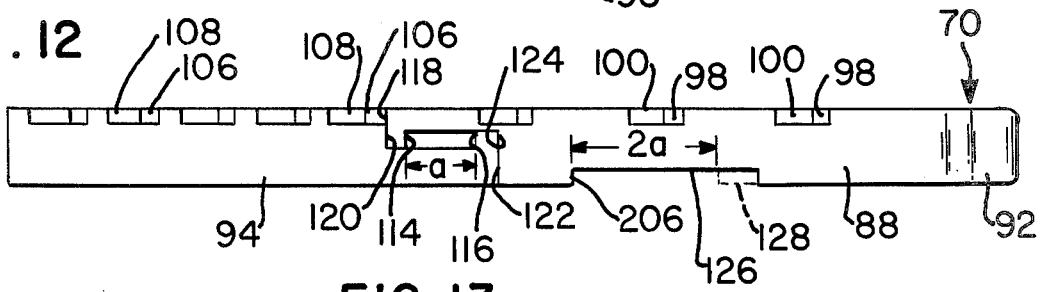
FIG. 12 is a view taken along the line 12—12 of FIG. 11 to show the actuating member of the actuating means shown in FIG. 11.

The actuating means for moving the contacts of the first and second groups (30, 32) of contacts 34, 36 between the retracted and expanded positions includes the actuating member 70 (FIGS. 11, 12, 16 and 17) and certain cooperating elements to be described hereinafter. The actuating member 70 includes a first "U" shaped portion having first and second legs 88 and 90, respectively, and a grasping portion 92 which is shaped to facilitate manual grasping by the thumb and index finger of a user. The actuating member 70 also includes third and fourth discrete legs 94 and 96 as shown in FIGS. 11 and 12. The actuating member 70 is made of a conventional, tough, plastic material such as a glass filled nylon with polytetrafluorethylene and silicone being added to provide additional strength. One such material which may be used contains by volume 20% of glass fibers, 20% of polytetrafluorethylene, 2% of Dow Cornings silicone #200 fluid and the balance is a nylon 6/6 base resin. Such a material having the designation "RFL-4044, FR, Black ER" may be purchased from the LNP Corporation of Malvern, Pennsylvania. The first leg 88 has a plurality of recesses 98 and camming or ramp surfaces 100 therein on the side of the leg 88 which is opposed to the side which engages the side 68 of the female member 22. The second leg 90 has recesses 102 and ramp surfaces 104 similarly located therein in opposed relationship to the recesses 98 and the ramp surfaces 100. The third leg 94 also has a plurality of recesses 106 and ramp surfaces 108 therein; while these recesses and ramp surfaces are shown placed closer together than the recesses 98 and ramp surfaces 100 of the first leg 88, for example, they may be spaced in the same manner as are the recesses 98 and the ramp surfaces 100 of the first leg 88. The fourth leg 96 has recesses 110 and ramp surfaces 112 similarly located therein in opposed relationship to the recesses 106 and ramp surfaces 108 as shown in FIG. 11.

The first and second legs 88 and 90 each have a first abutment surface 114 which coacts with a first abutment surface 116 on the third leg 94 and a similar surface 116 on the fourth leg 96 when the actuating member 70 is pulled to the right as viewed in FIG. 11. Each of the first and second legs 88, 90 also has a second abutment surface 118 thereon which coacts with a respective second abutment surface 120 on each of the third and fourth legs 94, 96 as will be described hereinafter. Each of the first and second legs 88, 90 has a third abutment surface 122 thereon which coacts with an associated abutment surface 124 on each of the third and fourth legs 94, 96. Each of the first and second legs 88, 90, has a recess 126 (FIG. 12) therein which recesses coact with opposed abutment members 128 and 130 (FIGS. 11, 12, and 4) located on opposed sides of the female member 22 to limit the movement of the actuating member 20 in opposed directions when the actuating member 70 is positioned against the sides 66 and 68 of the female member 22.

Figure 13:
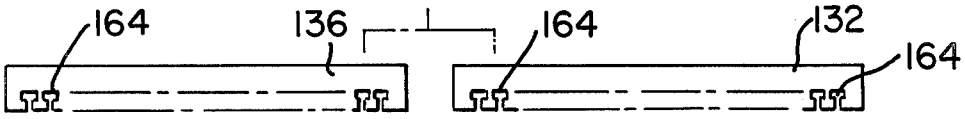
FIG. 13 is a top view of two retractor means which are part of the actuator means and are located on one side of the female member.
Figure 14:
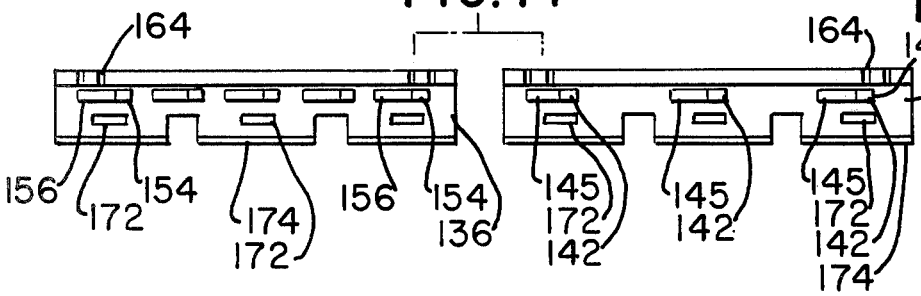
FIG. 14 is a side view of the retractor means shown in FIG. 13.
Figure 15:
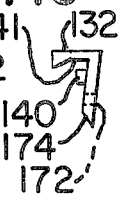
FIG. 15 is a right, end view of one of the retractor means shown in FIG. 14.

The actuating means for moving the contacts 34, 36 of the first and second groups 30, 32 of contacts also includes four retractor means or retractor wings 132, 134, 136, and 138 as shown in FIGS. 11, 13, and 14, these retractor wings may be made of the same plastic material as is the female member 22. The retractor wing 132 has camming lugs 140 positioned along the length thereof as shown in FIGS. 11 and 14 and these lugs are complementary in shape to and aligned with the recesses 102 and ramp surfaces 104 located in second leg 90 so that the lugs 140 fit into the associated recesses 102 and against the associated ramp surface 104 when the retractor wing 132 is mounted on the female body 22 as shown in FIG. 18, and the actuating member 70 is in the first position shown in FIG. 11 in which all the contacts 34 and 36 are in the restored position to engage the contacts of a complementary member such as 26 inserted in the slot 24. Each of the lugs 140 has a flat surface 142 which is parallel to the side 144 of the second leg 90 and a cam surface 145 as shown in FIG. 11. The retractor wing 134 has lugs 146 thereon arranged in the same manner as are lugs 140, and each of the lugs 146 similarly has a flat surface 148 and a cam surface 150 thereon. The retractor wing 136 similarly has lugs 152 with flat surfaces 154 and camming surfaces 156 for engagement with the recesses 110 and ramp surfaces 112, respectively, on the fourth leg 96. The retractor wing 138 similarly has lugs 158 with flat surfaces 160 and camming surfaces 162 for engagement with the recesses 106 and the ramp surfaces 108 of the third leg 94. The retractor wings 132 and 134 are mirror images of each other and similarly, the retractor wings 136 and 138 are mirror images of each other, otherwise the retractor wings 132, 134, 136, and 138 are all alike. While the lugs 140, for example, are shown as being slightly displaced from the underside 141 (FIG. 15) of the retractor wing 132 to facilitate the showing of these members, they are preferably located at the underside 141 due to the requirements of injection molding techniques by which the retractor wing 132 is made; the same is true for the lugs 146, 158, and 152. Each of the retractor wings 132, 134, 136, and 138 has "T-shaped" openings 164 therein to coact with the associated contacts 34, 36 as shown in FIG. 18. The contacts 34 have ears 166 extending therefrom to coact with the abutment surfaces 168 in the T-shaped openings 164 to move the contacts 34 to the expanded position although the contacts 34 are shown as being slightly displaced from these surfaces 168 in FIG. 18 to facilitate the showing thereof. The contacts 36 have ears 170 for the same purpose. Each of the retractor wings 132, 134, 136, and 138 has spaced openings 172 therein as shown in FIG. 14 for the retractor wings 132 and 136. The openings 172 on the retractor wings 132 and 136 coact with the depending flange 77 on the projections 76 on the female member 22 (FIG. 1) and the openings 172 on the retractor wings 134 and 138 coact with the depending flange 77 on the projections 78 on the female member 22 as is best shown in FIG. 16 to enable the retractor wings 132, 134, 136, and 138 to pivot on the female member 22 as is shown by retractor wing 134 in FIG. 17.

The retractor wings 132 and 134 operate together to move the contacts 34 and 36, respectively, of the first group 30 of contacts when the actuating member 70 is moved in a first direction as will be later described herein. The retractor wings 132 and 134 are shaped to conform to the sloping top sides 86 and 84, respectively, as is best shown in FIG. 16; this facilitates the retention of the retractor wings 132 and 134 on the female member 22. The retractor wing 134 pivots about the projection 78 from the position shown in FIG. 16 to the position shown in FIG. 17 when moved by the actuating member 70. The lower edge 176 of retractor wing 134 is chamfered to facilitate the pivoting as shown in FIG. 17; this same feature exists for all the other retractor wings 132, 136, and 138. The retractor wings 136 and 138 operate together in the same manner as just described in relation to retractor wings 132 and 134.

The male member 26 shown in FIGS. 6–9 and 16 is a prior-art connector which has a body member 178 which has opposed sides 180 and 182 thereon, with the contacts 184 being located along the side 180 to be engaged by the contacts 36, and with the contacts 186 being located on the side 182 to be engaged by the contacts 34 when the male member 26 is inserted in the female member 22 as viewed from FIG. 16. The contacts 184 extend through the body member 178 and have bent over portions 188 which engage associated contacts 190 on a printed circuit board 192. Similarly, the contacts 186 extend through the body member 178 and have bent over portions 194 which engage the associated contacts 196 on the printed circuit board 192. The male member 26 has holes 198 therein (with each hole 198 having an annular shoulder 199 therein) which enable the male member 26 to be secured to the printed circuit board 192 as previously described. The locating flanges 191 on the male member 26 fit into associated holes 193 in the printed circuit board 192 to enable the male member 26 to be located and secured thereto by suitable fasteners (not shown).

The legs 88, 90, 94 and 96 of the actuating member lie between the sides 66 and 68 of the female member 22 and the retractor wings 132, 134, 136, and 138 as shown in FIGS. 11 and 16. When the actuating member 70 is in the position shown in FIG. 18, the contacts 34 and 36 are biased towards the center of the slot 24 as shown in FIG. 16; in this position the male member 26 cannot be easily inserted into the slot 24.

When it is desired to insert the male member 26 into the slot 24 (FIG. 16), the actuating member 70 is manually grasped and pulled in a first direction (to the right as viewed in FIG. 18). As the actuating member 70 is pulled in the first direction, the ramp surfaces 100 (FIG. 11) on the first leg 88 engage the cam surfaces 150 on the retractor wing 134 and similarly, the ramp surfaces 104 on the second leg 90 engage the cam surfaces 145 on the retractor wing 132 to cause both retractor wings 132 and 134 to move away from the position shown in FIG. 16 to the expanded position shown for retractor wing 134 in FIG. 17. When in the position shown in FIG. 17, the flat surfaces 148 of the lugs 146 are wedged against the side 200 (FIG. 11) of the first leg 88, and similarly, the flat surfaces 142 of the camming lugs 140 on the retractor wing 132 are wedged against the flat side 144 of the second leg 90 to hold the retractor wings 132 and 134 in the expanded position as the actuating member is pulled further in the first direction to then cause the retractor wings 136 and 138 to be moved simultaneously with each other to the expanded position.

As the actuating member 70 is moved further in the first direction, the abutment surfaces 114 of the first and second legs 88 and 90 approach the abutment surfaces 116 on the third and fourth legs 94 and 96 as is best shown in FIG. 12. By the time that these abutment surfaces 114 and 116 engage each other, the flat surfaces 148 of lugs 146 are sliding on the side 200 of the first leg 88 and the flat surfaces 142 of lugs 140 are sliding on the side 144 of the second leg 90 to maintain the retractor wings 134 and 132 in the expanded positions, and accordingly maintain the contacts 34, 36 of the first group 30 in the expanded position.

Continued movement of the actuating member 70 in the first direction will cause the third and fourth legs 94 and 96 to also be pulled in the first direction via the abutment surfaces 114 and 116 contacting each other. As the third and fourth legs 94 and 96 are pulled in the first direction, the ramp surfaces 108 of the third leg 94 coact with the cam surfaces 162 of the lugs 158 on the retractor wing 138 to move it to the expanded position, where the flat surfaces 160 on the lugs 158 rest on the side 202 of the leg 94, and similarly, the ramp surfaces 112 of the fourth leg 96 coact with the cam surfaces 156 of the lugs 152 on the retractor wing 136 to move it to the expanded position where the flat surfaces 154 of the lugs 152 rest on the side 204 of the fourth leg 96 to thereby hold the contacts 34, 36 of the second group 32 in the expanded position. The retractor wings 132, 134, 136, and 138 are restrained from lateral movement along the length of the female member 22, when the actuating member 70 is moved, by the projections 76 (FIG. 1), for example, coacting with the associated holes 172 (FIG. 14) in retractor wing 132. When the actuating member 70 is in the position shown in FIG. 12, the space between the abutment surfaces 114 and 116 is equal to a distance "a", and the distance between the edge 206 of recess 126 and the abutment stop 128 (shown in phantom outline) is equal to "2*a*" as shown. The stops 128 and 130 limit the movement of the actuating member 70 in the first direction and in a second direction which is the opposite to the first direction. When the retractor wings 132, 134, 136, and 138 are in the expanded position, as shown by retractor wing 134 in FIG. 17, the contacts 34 and 36 of the first and second groups 30, 32 are carried thereby to the expanded position to enable the male member 26 to be inserted in the slot 24 in female member 22 with zero-insertion force. Thereafter, the actuating member is moved in a reverse or second direction (to the left as viewed in FIG. 18) to enable the contacts 34, 36 to engage the associated contacts 186 and 184, respectively, on the male member 26 to form an electrical connection therebetween.

When the actuating member 70 is moved in the second direction, the first and second legs 88 and 90 are moved for a distance equal to "a" (mentioned earlier herein) while the flat faces 148 of lugs 146 (FIG. 11) ride on the side 200 of first leg 88 and the flat faces 142 of lugs 140 ride on the side 144 of second leg 90 before engaging the ramp surfaces 100 of the first leg 88 and the ramp surfaces 104 on the second leg 90. Also, by the time that the first and second legs 88, 90 have moved for the distance "a" in the second direction, the abutment surfaces 118 and 122 (FIG. 12) thereon will engage the associated abutment surfaces 120 and 124, respectively, on the third and fourth legs 94, 96 to cause the legs 94 and 96 to be moved simultaneously in the second direction with the first and second legs 88, 90. Upon continued movement of the actuating member 70 in the second direction for an additional distance equal to "a", the actuating member 70 will assume the position shown in FIG. 11 in which the recesses such as recess 98 are aligned with the associated lugs such as 146 on the retractor wing 134 and the recesses such as recess 106 on the third leg 94 are aligned with the lugs such as 158 on the retractor wing 138, to permit the biasing provided by the contacts 34, 36 to simultaneously move these contacts of the first and second groups 30, 32 to the position shown in FIG. 16 for engagement with the associated contacts 186, 184 on the male member 26.

What is claimed is:

1. A substantial zero-insertion force, electrical connector comprising:

a member having a slot therein to receive a complementary member;

first and second groups of contacts located in said member to engage said complementary member; and actuating means including an actuating member for sequentially moving the contacts of said first and second groups between first and second positions whereby said actuating member, when moved in a first direction, is effective to move the contacts of said first group to said second position and whereby further movement of said actuating member in said first direction is effective to move the contacts of said second group to said second position to enable said complementary member to be inserted in said slot with substantial zero-insertion force;

said actuating means further comprising first and second pairs of retractor means operatively connected with said first and second groups of contacts, respectively, and further comprising means interconnecting said first and second pairs of retractor means with said actuating member, said actuating member having first and second portions associated respectively with said first and second groups of contacts for sequentially moving the contacts of said first and second groups from said first position to said second position as said actuating member is moved in said first direction;

said first portions of said actuating member having first abutment areas thereon and said second portions of said actuating member having second abutment areas thereon, which said first and second abutment areas are arranged on said actuating member to coact with each other to enable said second group of contacts to be moved to said second position after said first group of contacts is moved to said second position as said actuating member is moved in said first direction.

2. A substantial zero-insertion force, electrical connector comprising:

a member having a slot therein to receive a complementary member;

first and second groups of contacts located in said member to engage said complementary member; and actuating means including an actuating member for sequentially moving the contacts of said first and second groups between first and second positions whereby said actuating member, when moved in a first direction, is effective to move the contacts of said first group to said second position and whereby further movement of said actuating member in said first direction is effective to move the contacts of said second group to said second position to enable said complementary member to be inserted in said slot with substantial zero-insertion force;

said actuating means further comprising first and second pairs of retractor means operatively connected with said first and second groups of contacts, respectively, and further comprising means interconnecting said first and second pairs of retractor means with said actuating means for sequentially moving the contacts of said first and second groups from said first position to said second position; and said interconnecting means comprising camming lugs located on said first and second pairs of retractor means and cooperative camming surfaces located on said actuating member.

3. The connector as claimed in claim 2 whereby said actuating means is effective upon movement of said actuating member in a second direction opposite to said first direction to simultaneously move the contacts of said first and second groups from said second position to said first position.

4. A substantial zero-insertion force, electrical connector comprising:

a member having a slot therein to receive a complementary member;

first and second groups of contacts located in said member to engage said complementary member; and actuating means including an actuating member for sequentially moving the contacts of said first and second groups between first and second positions whereby said actuating member, when moved in a first direction, is effective to move the contacts of said first group to said second position and whereby further movement of said actuating member in said first direction is effective to move the contacts of said second group to said second position to enable said complementary member to be inserted in said slot with substantial zero-insertion force;

said contacts of said first and second groups being biased to move towards said first position;

said member having opposed sides against which said actuating member moves;

said actuating member also having spaced camming surfaces along the length thereof; and said actuating means further comprising first and second pairs of retractor means for engaging the contacts of said first and second groups, and also having means for pivotally mounting said first and second pairs of retractor means on said member; and said first and second pairs of retractor means also having spaced camming lugs along the length thereof to coact with said camming surfaces to move said contacts of said first and second groups, respectively, to said second position upon the movement of said actuating member in said first direction.

5. The connector as claimed in claim 4 in which said actuating member has a first portion and second portions with said first portion of said actuating member being generally U-shaped having first and second legs to engage said opposed sides of said member, with said first and second legs each having first and second abutment surfaces thereon;

said second portions being third and fourth legs positioned against said opposed sides of said member;

said third and fourth legs each having first and second abutment surfaces thereon for coaction with said first and second abutment surfaces, respectively, of said first and second legs whereby said first abutment surfaces of said first and second legs coact with said first abutment surfaces of said third and fourth legs to be operative to move said contacts of said second group to said second position after said contacts of said first group have been moved to said second position upon continued movement of said actuating member in said first direction and whereby said second abutment surfaces of said first and second legs coact with said second abutment surfaces of said third and fourth legs, respectively, to be operative to move said contacts of said first and second groups to said first position upon movement of said actuating member in a second direction which is opposite to said first direction.

6. The connector as claimed in claim 5 in which said first abutment surfaces of said first and second legs and said first abutment surfaces of said third and fourth legs are spaced apart a predetermined distance when said contacts of said first and second groups are in said first position.

7. The connector as claimed in claim 6 in which said first, second, third and fourth legs have said camming surfaces located thereon, and said camming surfaces on said first and second legs are spaced apart farther than the said camming surfaces on said third and fourth legs.

* * * * *